United States Patent [19]

Meyers

[11] 4,113,104

[45] Sep. 12, 1978

[54] TAMPERPROOF RECLOSABLE CARTON

[75] Inventor: George Leroy Meyers, Menasha, Wis.

[73] Assignee: American Can Company, Greenwich, Conn.

[21] Appl. No.: 805,096

[22] Filed: Jun. 9, 1977

[51] Int. Cl.[2] ..... B65D 17/16

[52] U.S. Cl. ..... 206/626; 229/37 R

[58] Field of Search ..... 206/622, 626, 629, 621, 206/624, 625; 229/37 R, 33, 36, 44 R

[56] References Cited

U.S. PATENT DOCUMENTS

| | | | |
|---|---|---|---|
| 3,378,188 | 4/1968 | Meyers | 206/611 |
| 3,563,451 | 2/1971 | Rosenburg, Jr. | 206/629 |
| 3,680,767 | 8/1972 | De Lorenzo et al. | 206/629 |
| 3,893,614 | 7/1975 | Meyers | 206/626 |

*Primary Examiner*—Stephen P. Garbe

*Attorney, Agent, or Firm*—Robert P. Auber; Ira S. Dorman; Ernestine C. Bartlett

[57] ABSTRACT

Tamperproof reclosable cartons are provided from a single paperboard blank which includes a receptacle portion and a cover portion which telescopes over the upper edges of the receptacle portion. The cover portion includes a front cover panel and the front wall panel of the receptacle portion includes an integral bridging panel comprising a central sealing tab and flanking tab portions. The front cover panel comprises at least one central tab area outlined by readily severable lines of weakness designed to be punched out upon opening the carton providing a readily visible indication that the carton has been opened.

32 Claims, 17 Drawing Figures

FIG. 4
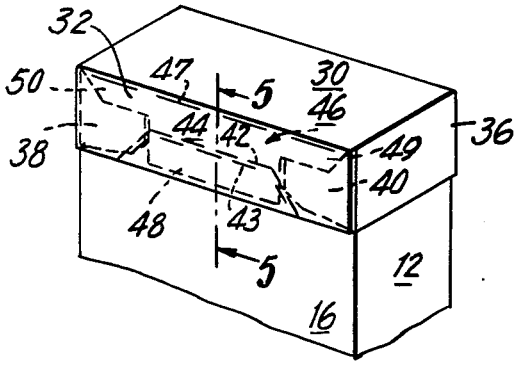
FIG. 5
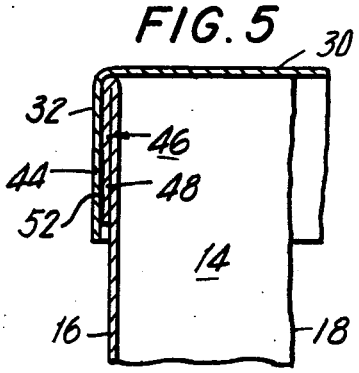
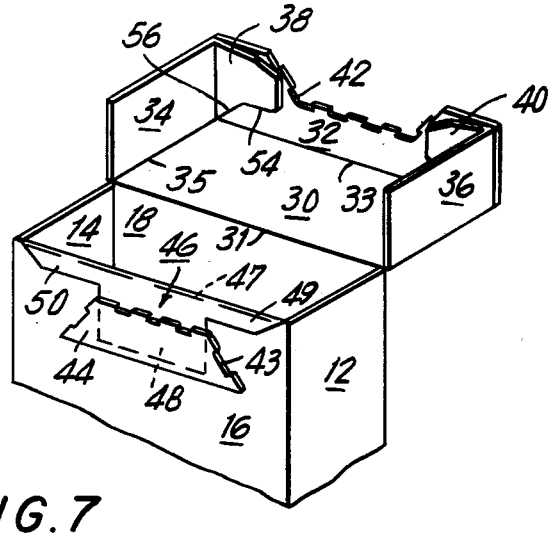
FIG. 7
FIG. 6
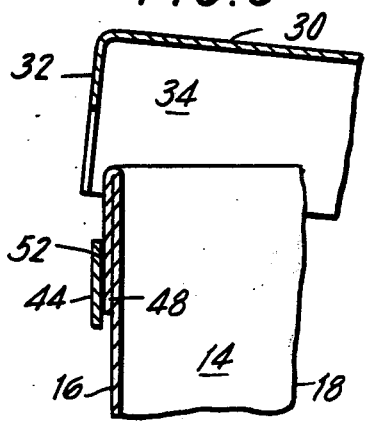
FIG. 8
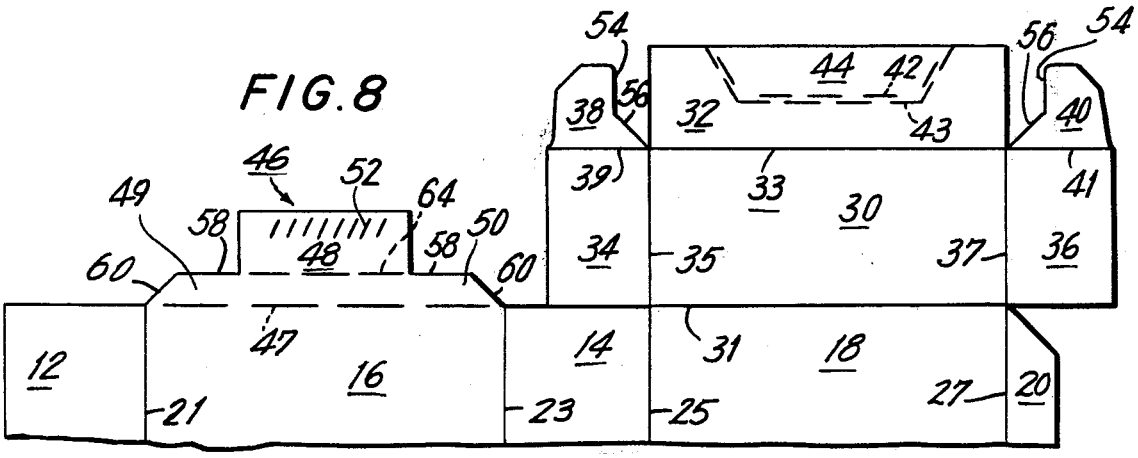

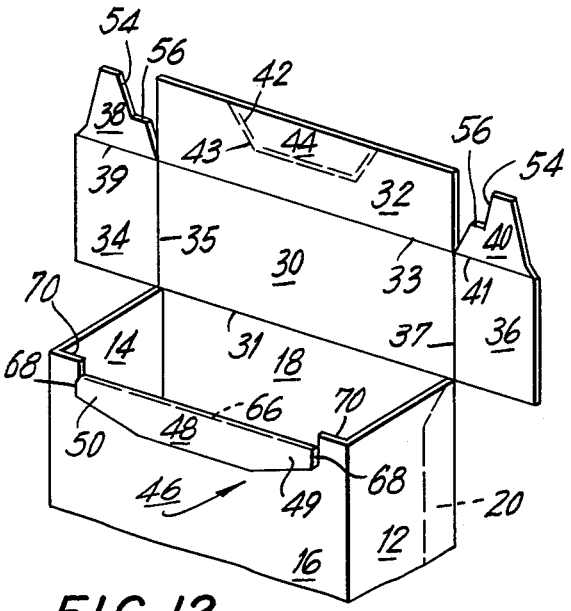
FIG. 12
FIG. 13
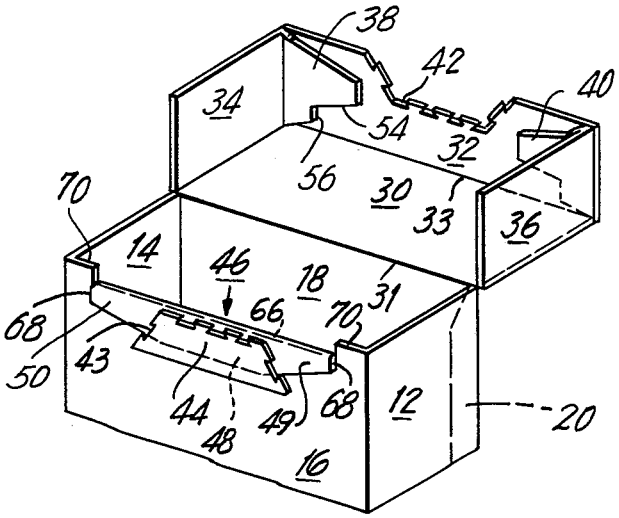
FIG. 14
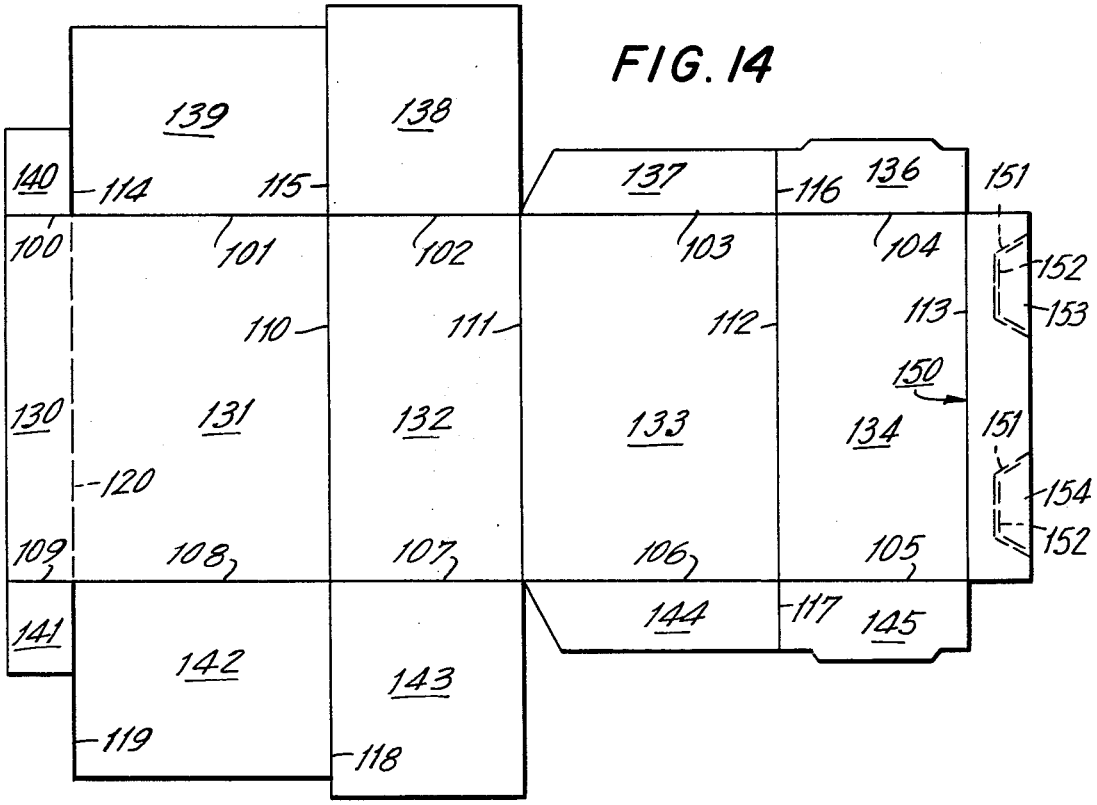

TAMPERPROOF RECLOSABLE CARTON

BACKGROUND OF THE INVENTION

It is now customary to package many products in a sealed carton which when opened has a receptacle portion and a cover portion which telescopes over the carton receptacle portion when closed. Many of such cartons, for example those of the flip-top variety, are generally packaged without overwrap material and are particularly susceptible to tampering. Such tampering is a serious problem with packages containing multiple packets of goods. It often occurs that consumers purchase such cartons and when ready to use the product, find less than the expected number of packets. The tampering is not readily detected before opening of the package since the lines of perforation severed in opening the carton are behind the front cover panel and are therefore not readily visible.

This invention relates to blanks and cartons constructed therefrom of the flip-top type, and is particularly concerned with the provision of a construction which provides a visible indication of tampering and means for reclosing the same after opening.

It is therefore an object of this invention to provide a carton produced from a single blank which provides a visible indication of tampering and is reclosable. A further object is to provide a carton which minimizes paperboard consumption due to is construction.

It is yet a further object of this invention to provide an economical, tamperproof reclosable carton which can readily be set up, filled and sealed by automatic machinery.

SUMMARY OF THE INVENTION

These and other objects are realized in the carton of this invention wherein the front cover panel comprises at least one central tab area outlined by readily severable lines of weakness and adhered to a bridging panel comprising seal tab and flanking lock tab portions. Upon opening, the adhered perforated central tab portion separates from the front cover panel and either remains adhered to the bridging panel or is completely severed and discarded. The carton also includes in one embodiment a reclosing means through edge abutment of angled side edges of the flanking tab portions of the bridging panel and complementary angled edge portions of the cover front corner glue tabs and, in another embodiment of the invention, relocking also through intermeshing of corresponding projections and indentations in the retained tab and punch-out portions of the central tab on the front cover panel.

BRIEF DESCRIPTION OF THE DRAWINGS

Further details of the invention will be apparent in the description of the drawings wherein:

FIG. 4 is a fragmentary perspective view of the sealed carton, certain unexposed panel elements being shown in phantom line, FIG. 5 is a cross-sectional view along line 5—5 of FIG. 4, FIG. 6 is a cross-sectional view along the same line as FIG. 5 but with the carton partly opened;

FIG. 7 is a fragmentary perspective view of the carton in fully open condition,

FIG. 8 is a fragmentary plan view of a paperboard carton blank comprising another preferred embodiment of the invention, FIG. 12 is a fragmentary perspective view of the carton of FIG. 11 partially set up, FIG. 13 is a fragmentary perspective view of the carton of FIG. 11 in fully open condition, FIG. 14 is a plan view of a paperboard carton blank comprising another embodiment of this invention.

DETAILED DESCRIPTION OF THE PREFERRED EMBODIMENTS

Figure 1:
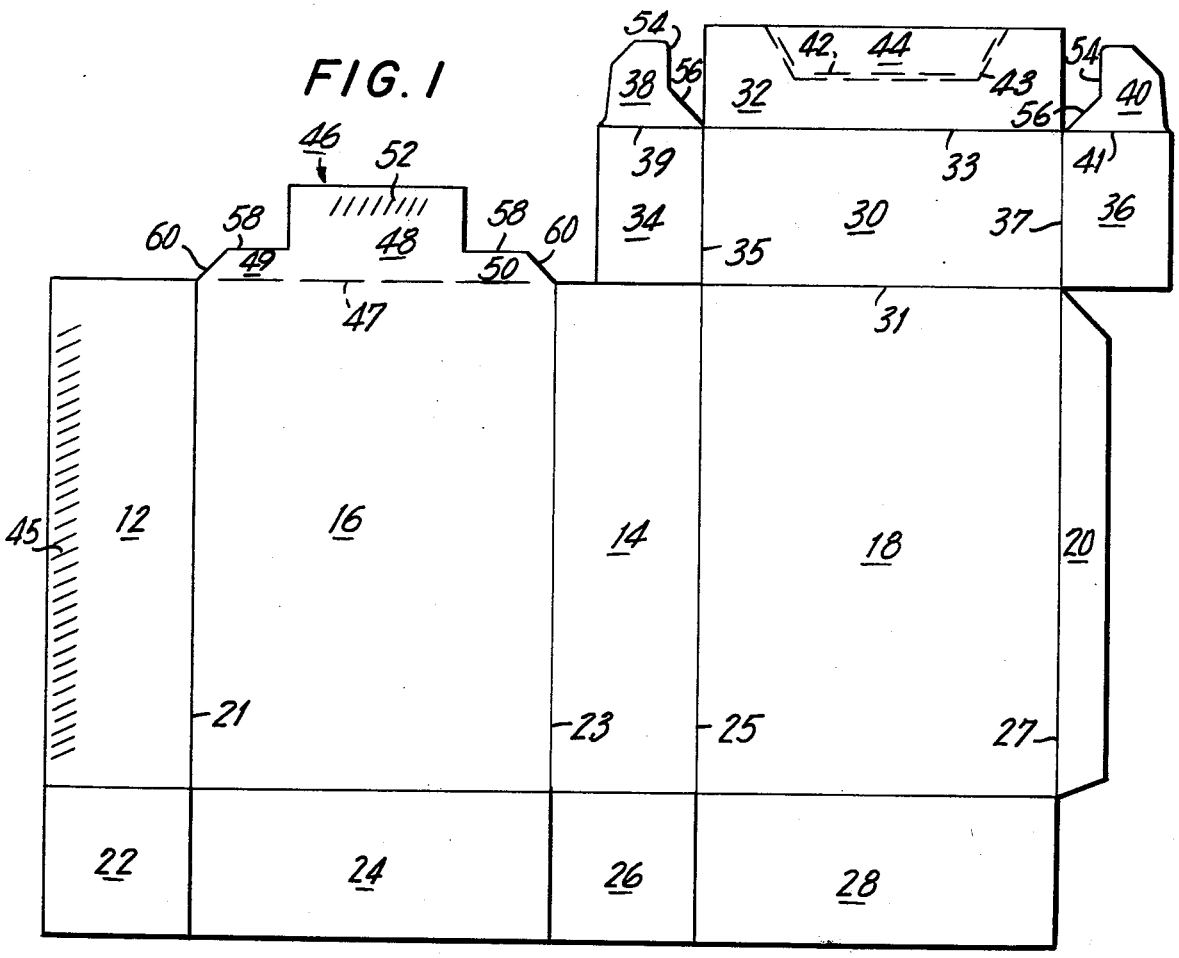
FIG. 1 is a plan view of a paperboard carton blank comprising a preferred embodiment of this invention.

The carton of this invention is formed of a blank of paperboard or similar material cut and scored as shown in the embodiment illustrated in FIGS. 1 to 7 to provide a pair of opposed end wall panels 12 and 14, a front wall panel 16, a back wall panel 18 and a manufacturer's glue panel 20, hingedly joined in sequence along parallel score lines 21, 23, 25 and 27. Hingedly depending from the lower edge of said receptacle end, front and rear wall panels are bottom closure panels 22, 24, 26 and 28, respectively.

Top cover panel 30 is hingedly connected at its rear edge along score line 31 to the upper edge of receptacle rear wall panel 18. Top cover panel 30 is also hinged at its front edge along score line 33 to front cover panel 32 and at its side edges along score lines 35 and 37 to end cover panels 34 and 36, respectively. End cover panels 34 and 36 have cover front corner glue flaps 38 and 40 hingedly connected to their respective front edges along score lines 39 and 41.

Bridging panel 46 is formed to have a seal tab portion 48 integral with flanking lock tab portions 49 and 50. Bridging panel 46 is hinged at its back edge along a line of weakness 47 to receptacle front wall panel 16. It will be apparent that the carton construction up to this point has involved conventional construction.

The prime innovative feature of the carton of this invention is in the construction of the front cover panel 32 wherein primary perforated lines 42 and secondary perforated lines 43 are provided which function to define that portion of the central tab 44 that separates from the front cover panel upon opening the carton as described further hereinbelow.

In forming the carton of this invention from the blank hereinbefore described, a suitable adhesive 45 is applied to the area adjacent to the free edge of end wall panel 12 or alternatively, to the manufacturer's glue flap 20, after which the blank is folded to bring the areas into superposition, all in accordance with long established procedures. Similarly, adhesive is applied in known manner to some or all of the bottom closure panels 22, 24 and 26 which are constructed to dovetail with the edges of bottom closure panel 28 forming a bottom structure of conventional construction.

Figure 2:
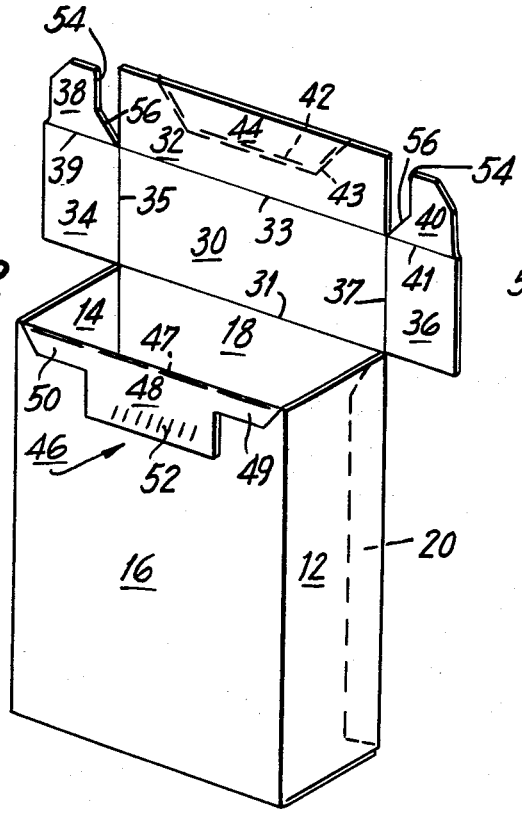
FIG. 2 is a perspective view of the carton partially set up.

After folding the bridging panel 46 outward to lie superposed on the upper portion of the outer surface of front wall panel 16, the partially erected carton appears as shown in FIG. 2 in which position the carton may be filled with product and prepared for closure and sealing. Adhesive area 44 is indicated adjacent the remote free edge of front cover panel 32 in FIGS. 1, 2 and 3. The adhesive area is configured to coincide with the shape of seal tab 48 of the bridging panel so that upon sealing only the seal tab portion is adhered. Alternatively, the adhesive may be applied to adhesive area 52 of the bridging panel defining the seal tab 48 or it may be applied to both the seal tab 48 and the central tab portion 44 on the front cover panel 32. The adhesive applied to any of the adhesive areas referred to may be the same or different adhesive compositions. Preferably, hot-melt or heat-seal adhesive compositions are employed.

Figure 3:
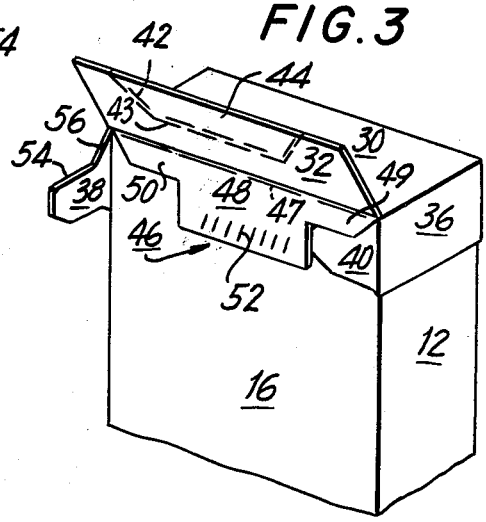
FIG. 3 is a fragmentary perspective view of the carton at one stage during the closing and sealing procedure.

The final steps in the closure and sealing of the filled carton are illustrated in FIGS. 3 and 4. The top cover panel 30 is folded about score line 31 to overlie and close the top opening of the receptacle, end cover panels 34 and 36 are folded about score lines 35 and 37 to lie superposed on end wall panels 14 and 12 and cover front corner glue flaps 38 and 40 are hinged about score lines 39 and 41 to lie adjacent to the areas of front panel 16 on which the outwardly folded bridging panel lies superposed. Front cover panel 32 is folded about score line 33 to lie superposed on the surfaces of the bridging panel 46, the cover front glue flaps 38 and 40 being thereby sandwiched between the inner surface of the front cover panel 32 and the outer surface of the receptacle front wall panel 16.

As best seen in FIG. 3 and in phantom line in FIG. 4, the edges 54 and 56 to the cover front glue flaps 38 and 40 dovetail snugly with the angled edges 58 and 60 of the flanking lock tabs 49 and 50 of the bridging panel.

In opening the sealed carton, force applied downwardly and inwardly, e.g. by pressing or punching, along the bottom edge of the front cover panel 32, results in severance of the perforated score lines 42 and 43 resulting in separation of the central tab position 44 from front cover panel 32. The central tab portion 44 remains adhered to seal tab 48. This separation of the central tab portion of the front cover panel thus constitutes the tamperproof feature of the carton providing a readily visible indication to the consumer on the carton front that the carton has been opened. Since the cover assembly of the carton is adhered to the seal tab 48, which is an integral part of the receptacle portion of the overall carton, the carton cannot be opened without rupturing the central tab portion of the front cover panel.

Upon reclosure of the carton, in the preferred embodiment, toothed projections, formed by the positioning of the primary and secondary perforated score lines 42 and 43 intermesh to provide a relocking feature. Additionally, the bridging panel 46, bearing the severed central tab portion from the front cover panel on its front face, and the lock tabs 49 and 50 resume their coplanar relationship with the corner glue flaps 38 and 40 with the free edges 54, 56, 58 and 60 of the various flaps and tabs being in locking abutment with each other. In this connection, each lock tab portion has a free edge 58 and an angled edge 60 while the glue flaps 38 and 40 have edges 54 and 56 which are shaped to dovetail with the lock tab edges. Edge 60 of each lock tab and abutting edge 56 of the glue flap are formed at the same angle to their respective hinge lines, are of substantially equal length and are thus complementary to each other. Such construction subjects the cover front corner glue flap edges to a wedging action if upwardly directed force is applied to the cover when the lock tabs and glue flaps are in the same plane.

Figure 9:
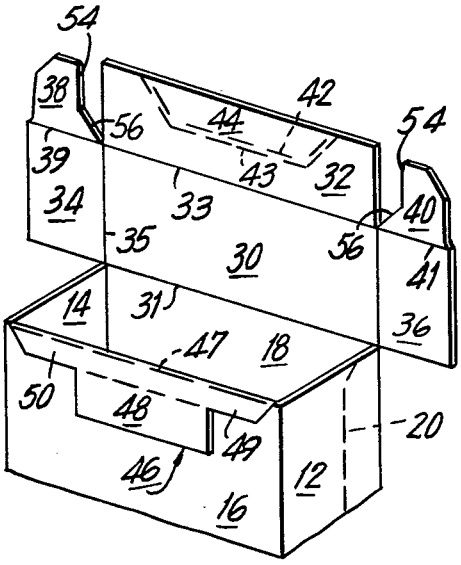
FIG. 9 is a fragmentary perspective view of the carton of FIG. 8 partially set up.
Figure 10:
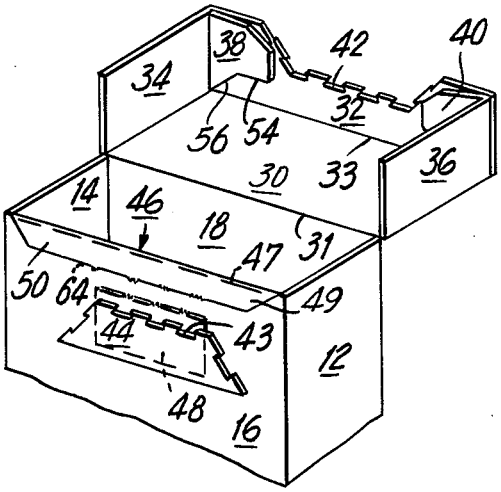
FIG. 10 is a fragmentary perspective view of the carton of FIG. 8 in fully open condition.

While the above description constitutes a preferred embodiment of the invention, modifications in the carton structure and opening feature are also contemplated. One such modification is illustrated in FIGS. 8 to 10 which differs from the above described carton in the provision of a severable line of weakness 64 at the base of the seal tab portion 48 of the bridging panel 46. In this embodiment, the carton is opened by pressing or punching downwardly on the central tab 44 of the front cover panel, the separated central tab portion adhered to the lower edge of the seal tab is subjected to an upward force, severed from the bridging panel and discarded as best seen in FIG. 10. The opening of this embodiment thus involves severance of the central tab portion of the front cover panel as well as severance of at least a portion of the seal tab of the bridging panel. The carton construction is otherwise the same as in the embodiment of FIGS. 1 to 7.

Figure 11:
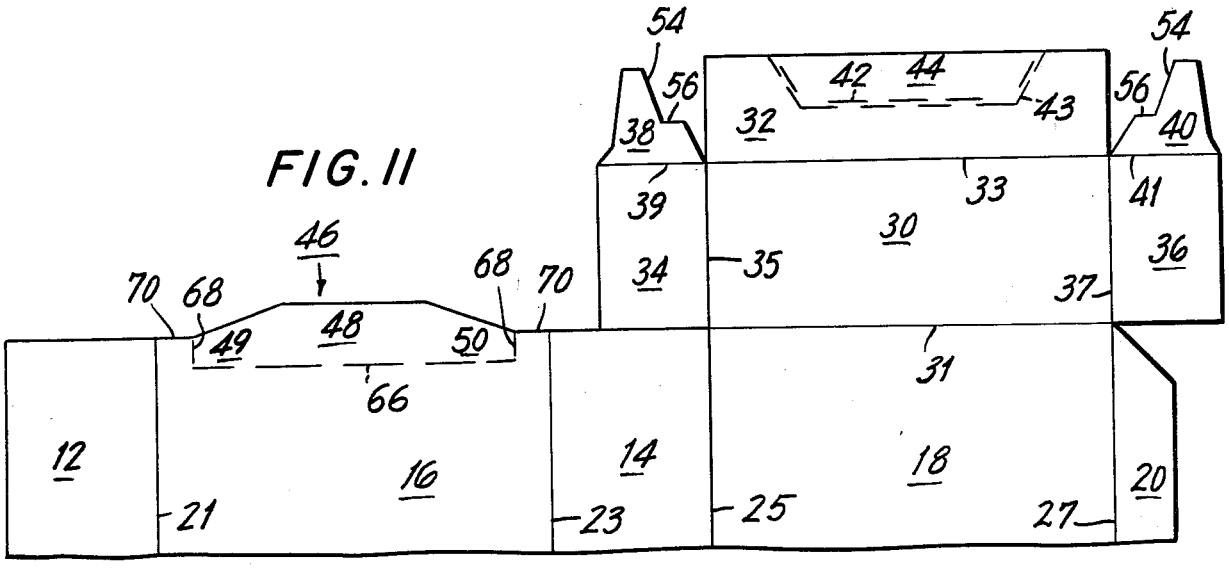
FIG. 11 is a fragmentary plan view of a paperboard carton blank comprising another preferred embodiment of the invention.

In another modification illustrated in FIGS. 11 to 13, a more economical construction is provided which differs from other embodiments in the construction of the bridging panel 46. As best seen in FIGS. 11 and 12, bridging panel 46 is formed integral with the front wall panel 16, is hingedly connected thereto by a perforated line of weakness 66 and is so constructed that a major portion thereof lies below the plane of the upper end of the front wall panel. In other words, the major portion of the bridging panel is formed from the front panel wall allowing for a minimizing of paperboard consumption and thus a more economical carton. The paperboard savings may best be understood with reference to the technique by which the carton blanks are manufactured. For example, on a commercial scale, multiple blanks are produced from a single sheet of paperboard. The basic layout on the sheet is such that the front cover panel of one blank will abut the bridging panel of the front wall of another, i.e. they are arranged on the sheet to permit construction of the maximum number of carton blanks. Where the bridging panel of the instant blank lies substantially below the plane of the end of the front panel wall, closer positioning of blanks is possible, more blanks are produced from a single sheet and paperboard consumption is reduced resulting in a more economical carton.

Additionally, in this embodiment, cut lines 68 define the free edges of the lock tabs and additionally provide free edges 70 of the front body panel, all of which function by abutment with the edges of the corner glue flaps to aid in relocking of the opened container. In this embodiment, as in that of FIGS. 1 to 7, the severable central tab portion 44 of the front cover panel 32 is glued to the central seal tab portion 48 of the bridging panel 46 and remains adhered thereto after severance upon opening.

While the above description constitutes preferred embodiments of the invention, other modifications in the carton structure and tamperproof opening feature are contemplated. The opening feature may be incorporated into any of a variety of cartons having cover and receptacle portions where the cover portion has a downwardly depending skirt that telescopes over the carton panels when the carton is closed. Additionally, particularly in large cartons, the opening feature may include more than one severable central tab portion on the front cover panel of the carton. One such modification may be seen in FIGS. 14 to 17 wherein a blank is provided wherein the shape of the flaps and panels, the order of folding and the construction of the front cover panel are altered. Referring to FIG. 14, a blank is divided into score lines 100–113, cut lines 114–119 and perforation lines 120 into hingedly connected panels and flaps including front panel 131, bottom panel 132, rear panel 133, top panel 134, bridging panel 130, end cover panels 136 and 145, end tabs 137 and 144, outer end flaps 138 and 143, inner end flaps 139 and 142, and glue flaps 140 and 141. Front panel 150 is comprised of two central tab portions 153 and 154 defined by lines of weakness 151 and 152.

The blank is formed into a glued carton shell by first applying adhesive to bridging panel 130 or to central tab portions 153 and 154, folding rear panel 133 with the elements attached thereto about score line 111 to lie superposed on bottom panel 132 and adhering cover panel 150 to the adhesive bearing surface of bridging panel 130.

Figure 15:
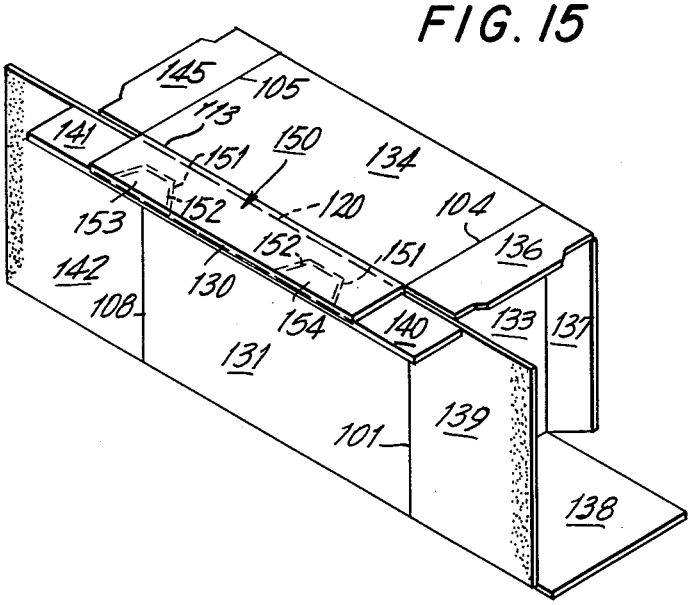
FIG. 15 is a fragmentary perspective view of the squared carton partially set up.

FIG. 15 depicts an initial stage in which the carton is squared and ready for filling. When the shell is squared, panels 131, 132, 133 and 134 are positioned consecutively at right angles to each other. Usually one end is closed and sealed, the carton filled and the other end closed and sealed. Since the closing and sealing steps are the same for both ends of the carton, reference is had to closing just one end of the carton.

Figure 16:
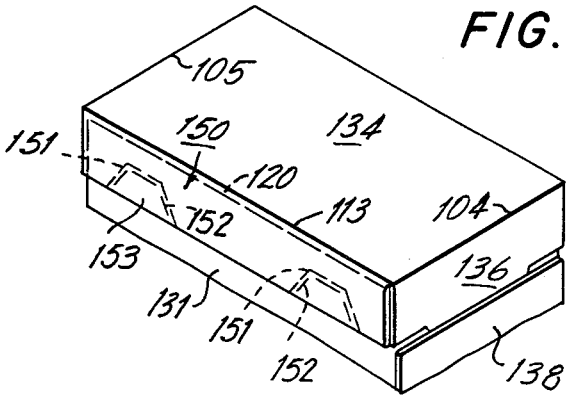
FIG. 16 is a fragmentary perspective view of the closed and sealed carton.
Figure 17:
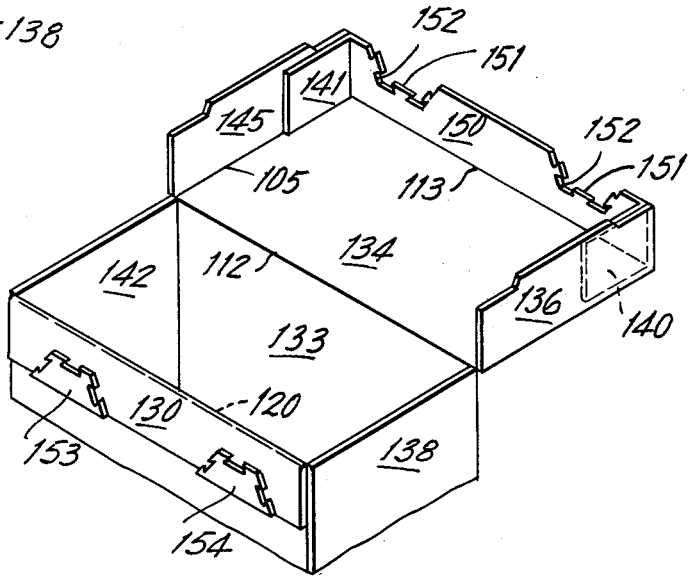
FIG. 17 is a fragmentary perspective view of the carton in fully open condition.

In closing the carton, adhesive is applied to the outer surface of inner end flap 139 in the stippled area shown in FIG. 15 and the flap 139 is infolded about score line 101 to position is perpendicularly to bottom panel 132. Next, end tab 137 is infolded to overlie and become adhered to the adhesive bearing outer surface of inner end flap 139. Bridging panel 130 and adhered front cover panel 150 are then folded down to lie parallel to front panel 131 while adhesive is applied to the outer surface of glue flap 140 and the flap infolded about score line 100 to lie superposed on inner end flap 130. Then end cover panel 136 is folded down about score line 104 to overlie portions of end tab 137 and inner end flap 139 and become adhered to glue flap 140. The closure is completed by applying adhesive to outer end flap 138 and then infolding outer end flap 138 and adhering it to end flap 137 and inner end flap 139. The closed and sealed carton is shown in FIG. 16 and the opened carton, which opens by severance of the adhered central tab portions on the cover panel 150 is shown in FIG. 17.

The present invention provides a carton construction using an integral blank that can be readily set up, filled and sealed with automatic machinery, that provides an economical feature for minimizing paperboard consumption and that opens in a novel feature that is readily adapted to cartons without limitation because of shape and size. It will be evident that the carton is of unique construction and that minor variations may be made without departing from the spirit and scope of the invention.

I claim:

1. In a reclosable paperboard carton formed of a single cut and scored blank having a receptacle portion and a cover portion which telescopes over the upper edges of the receptacle portion and wherein the receptacle portion comprises hingedly connected front, rear, end and bottom panels, the cover portion comprises a top cover panel hingedly connected to the upper edge of the rear panel, end cover panels and a front cover panel all hingedly connected to the top cover panel and forming skirt portions parallel and adjacent to the respective underlying panels, a bridging panel hingedly connected along a line of weakness to the upper edge of the receptacle panel and folded outwardly to lie sandwiched between the front cover panel and the front receptacle panel and adhesively secured to the front cover panel, the improvement wherein said front cover panel comprises at least one central tab portion, defined by severable lines of weakness and adhesively secured to said bridging panel whereby severance of said central tab from said front cover panel is effected upon opening the carton.

2. The carton of claim 1 wherein upon opening said carton, the adhesively secured central tab portion of said front cover panel separates therefrom and is retained on said bridging panel.

3. The carton of claim 1 wherein the severable central tab is defined by primary and secondary severable perforated lines.

4. The carton of claim 3 wherein said primary and secondary perforated lines are so positioned that toothed projections and corresponding indentations are formed in the front cover panel and retained tab portions respectively.

5. The carton of claim 1 wherein said bridging panel comprises seal tab and lock tab portions.

6. The carton of claim 5 wherein said seal tab is defined by severable perforated lines in said bridging panel.

7. The carton of claim 6 wherein upon opening of said carton, the adhesively secured central tab portion of said front cover panel and said seal tab portion of the bridging panel are separated from the carton.

8. The carton of claim 1 wherein a substantial portion of said bridging panel lies below the plane of the receptacle upper edge.

9. The carton of claim 8 wherein vertical cut lines extending from the upper edge of the receptacle from panel, in which said bridging panel is formed, define the side edge of each flanking lock tab.

10. The carton of claim 8 wherein upon opening said carton, the adhesively secured central tab portion of said front cover panel separates therefrom and is retained on said bridging panel.

11. A tamperproof reclosable carton formed of a single cut and scored blank having a receptacle portion and a cover portion which telescopes over the upper edges of the receptacle portion, said receptacle portion comprising hingedly connected front, rear, end and bottom receptacle panels, said cover portion comprising a top cover panel hingedly connected to the upper edge of said rear panel, a front cover panel hingedly connected to the upper edge of the top cover panel and end cover panels all forming skirt portions parallel and adjacent to the respective underlying receptacle panels; said front cover panel having a central tab portion, defined by severable lines of weakness whereby said tab portion is severable from said front cover panel upon opening the carton;

a bridging panel hingedly connected along a line of weakness to the center portion of the upper edge of said front receptacle panel, said bridging panel being folded outwardly along said hinge line to lie sandwiched between said front cover panel and said front receptacle panel and comprising a seal tab formed integral with flanking lock tabs and adhesively secured to the inner surface of the central tab portion of said front cover panel; a pair of front corner glue flaps each hingedly connected to a respective one of said end cover panels and adhesively secured to the inner surface of said front cover panel to lie sandwiched between said front receptacle panel and said front cover panel in the same plane as said bridging panel; each of the locking tab portions of said bridging panel having a side edge lying at an acute angle to said hinge line between said bridging panel and said front receptacle panel, said side edges being in edge to edge locking abutment with a complementary edge formed on said glue flaps.

12. The carton of claim 11 wherein upon opening said carton, the adhesively secured central tab portion of said front cover panel separates therefrom and is retained on said bridging panel.

13. The carton of claim 11 wherein the severable central tab is defined by primary and secondary severable perforated lines.

14. The carton of claim 13 wherein said primary and secondary perforated lines are so positioned that toothed projections and corresponding indentations are formed in the front cover panel and retained tab portions respectively.

15. The carton of claim 11 wherein said seal tab is defined by severable perforated lines in said bridging panel.

16. The carton of claim 15 wherein upon opening of said carton, the adhesively secured central tab portion of said front cover panel and said seal tab portion of the bridging panel are separated from the carton.

17. The carton of claim 11 wherein a substantial portion of said bridging panel lies below the plane of the receptacle upper edge.

18. The carton of claim 17 wherein vertical cut lines extending from the upper edge of the receptacle front panel, in which said bridging panel is formed, define the side edge of each flanking lock tab.

19. The carton of claim 18 wherein upon opening said carton, the adhesively secured central tab portion of said front cover panel separates therefrom and is retained on said bridging panel.

20. The carton of claim 11 wherein said front cover panel comprises a plurality of said severable central tab portions.

21. In a one-piece paperboard carton blank adapted to be formed into a carton having a receptacle portion comprising hingedly connected front, rear, end and bottom panels and a cover portion comprising a top cover panel hingedly connected to the upper edge of the rear panel, end cover panels and a front cover panel hingedly connected to the top cover panel and a bridging panel hingedly connected to the upper edge of the front panel, the improvement wherein each of said end cover panels has a front corner glue flap, hinged to a forward edge, said front cover panel comprises at least one central tab portion defined by severable lines of weakness whereby said tab portion is severable from said front cover panel upon opening the erected carton and said bridging panel comprises lock tab portions each having an angled side edge complimentary to a side edge of a corner glue flap and adapted to come into edge abutment therewith in the erected carton.

22. The carton blank of claim 21 wherein the severable central tab is defined by primary and secondary severable perforated lines.

23. The carton blank of claim 21 wherein bridging panel comprises seal tab and flanking lock tab portions.

24. The carton blank of claim 23 wherein said seal tab is defined by severable lines of weakness in said bridging panel.

25. The carton blank of claim 21 wherein a substantial portion of the bridging panel lies below the plane of the receptacle upper edge.

26. The carton blank of claim 21 having a plurality of said severable central tab portions on the front cover panel.

27. A one-piece carton blank adapted to be formed into a tamperproof carton with a reclosable cover, said blank comprising a front wall panel, a back wall panel, opposed end wall panels and a manufacturer's glue panel, hingedly connected in a series along parallel score lines, bottom closure panels hingedly attached to said wall panels, a cover assembly comprising a top cover panel hingedly connected to the upper edge of said back wall panel, a front cover panel hingedly attached to said top cover panel opposite said hinge connection to said back wall panel, a pair of end cover panels each hinged to a respective side edge of said top cover panel and a pair of cover front corner glue flaps each hinged to a respective forward edge of one of said end cover panels; said front cover panel having a central tab portion defined by severable lines of weakness; an integral bridging panel comprising a seal tab portion and flanking lock tab portions in the upper edge of said front wall panel, said bridging panel being hingedly attached along a line of weakness to the central portion of the upper edge of said front wall panel, the lock tab portions of said panel each having an angled side edge complementary to a side edge of a corner glue flap and adapted to come into edge abutment therewith in the erected carton.

28. A one-piece carton blank as claimed in claim 27 wherein said central tab portion of the front cover panel is defined by primary and secondary perforated lines.

29. A one-piece carton blank as claimed in claim 27 wherein said seal tab is defined by severable perforated lines in said bridging panel.

30. A one-piece carton blank as claimed in claim 27 wherein a substantial portion of said bridging panel lies. below the plane of the receptacle upper edge.

31. A one-piece carton blank as claimed in claim 30 wherein vertical cut lines extending from the upper edge of the receptacle front panel, in which the bridging panel is formed, define the side edge of each flanking lock tab.

32. A one-piece carton blank as claimed in claim 27 having a plurality of said severable central tab portions on the front cover panel.

* * * * *